US009048558B1

(12) United States Patent
Ke et al.

(10) Patent No.: US 9,048,558 B1
(45) Date of Patent: Jun. 2, 2015

(54) RECEPTACLE CONNECTOR

(71) Applicants: Inventec (Pudong) Technology Corporation, Shanghai (CN); INVENTEC CORPORATION, Taipei (TW)

(72) Inventors: Fa-Chih Ke, Taipei (TW); Ching-Hung Li, Taipei (TW); Tzu-Ti Ko, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 14/250,389

(22) Filed: Apr. 11, 2014

(30) Foreign Application Priority Data

Nov. 21, 2013 (CN) ..... 2013 1 0595145

(51) Int. Cl.
*H01R 13/44* (2006.01)
*H01R 13/453* (2006.01)

(52) U.S. Cl.
CPC ..... *H01R 13/4532* (2013.01)

(58) Field of Classification Search
CPC ..... H01R 13/4536; H01R 35/04
USPC ..... 439/138, 142, 131, 157, 159, 372
See application file for complete search history.

(56) References Cited

U.S. PATENT DOCUMENTS

| | | | | |
|---|---|---|---|---|
| 7,821,497 | B2 * | 10/2010 | Chu et al. | 345/163 |
| 8,371,878 | B2 * | 2/2013 | Tang | 439/630 |
| 8,605,451 | B2 * | 12/2013 | Tang | 361/754 |
| 8,814,582 | B2 * | 8/2014 | Lee et al. | 439/159 |

* cited by examiner

*Primary Examiner* — Phuongchi T Nguyen
(74) *Attorney, Agent, or Firm* — CKC & Partners Co., Ltd.

(57) ABSTRACT

A receptacle connector includes a main body, an insulating base, a tenon member, a compressing spring, and a cap body. The main body includes a first concave area. The insulating base includes a second concave area. The first and the second concave area constitute a joint cavity and an opening. The tenon member erected on the bottom surface of the first concave area and is threaded through the compression spring. The cap body includes a sheath portion slidably threaded through the tenon member and a cover portion occupied a part of the opening. The sheath portion is connected to the compression spring and when the sheath portion of the cap body compresses the compression spring, the cover portion of the cap body is capable of moving from a closing position to an accessing position relative to the opening.

9 Claims, 5 Drawing Sheets

RECEPTACLE CONNECTOR

RELATED APPLICATIONS

This application claims priority to Chinese Patent Application Number 201310595145.6, filed Nov. 21, 2013, which is herein incorporated by reference.

BACKGROUND

1. Field of Invention

The invention relates to a connector, and more particularly relates to a receptacle connector.

2. Description of Related Art

Receptacle Connectors connected to network-related devices are generally configured on the existing electronic apparatus, and more particularly a receptacle connector of RJ-45 type is usually used to connect with a corresponding plug connector.

For the current receptacle connector of RJ-45 type, the interface thereof is generally provided with a cap body which is capable of opening or closing alternatively for plug-in of the plug connector. In order to control opening or closing of the cap body, a torsion spring is generally arranged in the receptacle connector. The torsion spring is connected to the cap body and the main body of the receptacle connector simultaneously, such that once the plug connector is unplugged from the receptacle, the opened cap body is restored to a closing state automatically via the elastic restoring force of the torsion spring.

In most cases, the torsion spring is installed into the receptacle connector from the lateral direction, rather than forward installed. However, because the receptacle connector of RJ-45 type is generally connected together with the shell body of the electronic apparatus, it is difficult to install the torsion spring from the lateral direction to the receptacle connector.

SUMMARY

An aspect of the invention provides a receptacle connector for solving the problems of the prior art.

According to an embodiment of the invention, a receptacle connector is provided, which is adapted for being connected to a plug connector. The receptacle connector includes a main body, an insulating base, a tenon member, a compressing spring and a cap body. The main body includes a first concave area. The insulating base has a plurality of conductive terminals, and the insulating base includes a second concave area. The first and the second concave area constitute a joint cavity and an opening. A plug connector is adapted to be plugged into the joint cavity through the opening. The tenon member is erected on the bottom surface of the first concave area and is threaded through the compression spring. The cap body includes a sheath portion slidably threaded through the tenon member and a cover portion occupied a part of the opening, wherein the sheath portion and the cover portion are opposite to each other, and the sheath portion is connected to the compression spring. The plug connector is adapted to push the cap body, such that the sheath portion compresses the compressing spring to enable the cover portion to move from a closing position to an accessing position relative to the opening.

According to an embodiment of the invention, the sidewall of the first concave area has a notch, and the cap body has a rotating member. The rotating member includes a first portion and a second portion. The first portion is disposed inside the notch. The second portion extends from the first portion and is protruded from the notch, facing the sidewall of the first concave area. When the cover portion is located at an accessing position, the second portion abuts against the sidewall of the first concave area.

According to an embodiment of the invention, the notch includes top surface and a slide surface. When the cover portion is located at a closing position, the first portion abuts against the stop surface. Additionally, when the cover portion moves from the closing position to the accessing position, the first portion slides along the slide surface until the second portion abuts against the sidewall of the first concave area.

According to an embodiment of the invention, the receptacle connector further includes a circuit board. The circuit board includes a first surface and a second surface which are opposite to each other. The main body is fixed on the first surface. The insulating base is fixed on the second surface. The circuit board has a plurality of contact points which are electrically connected to respective conductive terminals.

According to an embodiment of the invention, the circuit board has a recessed part. The position of the recessed part is opposite to that of the second concave area.

According to an embodiment, the receptacle connector further includes a locking accessory, and the main body further includes a screw hole. The circuit board further includes a locking hole, and the position of the screw hole faces to that of the locking hole. The locking accessory passes through the locking hole and is screwed into the screw hole, so as to fix the connection between the main body and the circuit board.

According to an embodiment of the invention, the cap body has a sliding chute located in the joint cavity. The plug connector has an engaging piece, and when the plug connector is plugged into the joint cavity, the engaging piece is engaged with the sliding chute.

According to an embodiment of the invention, the opening is divided into a first concave part and a second concave part, in which the first concave part is located on the main body and the second concave part is located on the insulating base. The profile of the cover portion of the cap body and the first concave part are complementary.

According to an embodiment of the invention, the main body further includes a rib located on the bottom surface of the first concave area. The height of the rib is lower than that of the tenon member. The sheath portion of the cap body is located in the first concave area and supported by the rib.

According to an embodiment of the invention, the receptacle connector is installed into a shell body of an electronic apparatus.

In view of the above, for the invention, by threading the tenon member erected on the main body through the compressing spring, the compressing spring can be forward installed onto the main body quickly. Moreover, the compressing spring is connected to the main body and the cap body, and via the rotating member located at a side of the cap body, when the plug connector is plugged into the receptacle connector, the cap body can rotate clockwise along the rotating member as the axis center. When the plug connector is unplugged from the receptacle connector, via the elastic restoring force of the compressing spring, the cap body rotates counterclockwise around the rotating member as the axis center, such that the cap body can be restored to the closing position automatically.

BRIEF DESCRIPTION OF THE DRAWINGS

In order to make the invention as well as advantages thereof more apparent, the accompanying drawings are described as follows.

DETAILED DESCRIPTION

Embodiments of the invention will be described in details below. It should be noted that many applicable inventive concepts are provided in the invention, which can be embodied in wide-ranging applications. The specific embodiments discussed below are only used for illustration, and is not intended to limit the scope of the invention.

In the following embodiments, a receptacle connector is disclosed. In such a receptacle connector, a compressing spring replaces the conventional utilized torsion spring, so as to connect the main body of the receptacle and a cap body. Moreover during manufacture process of the receptacle connector, the compressing spring can be combined with the main body of the receptacle connector through a forward assembly manner. Therefore, compared to the lateral assembly manner of torsion spring required in the prior art, the forward assembly manner adopted in the following embodiments is easier and faster.

Figure 1:
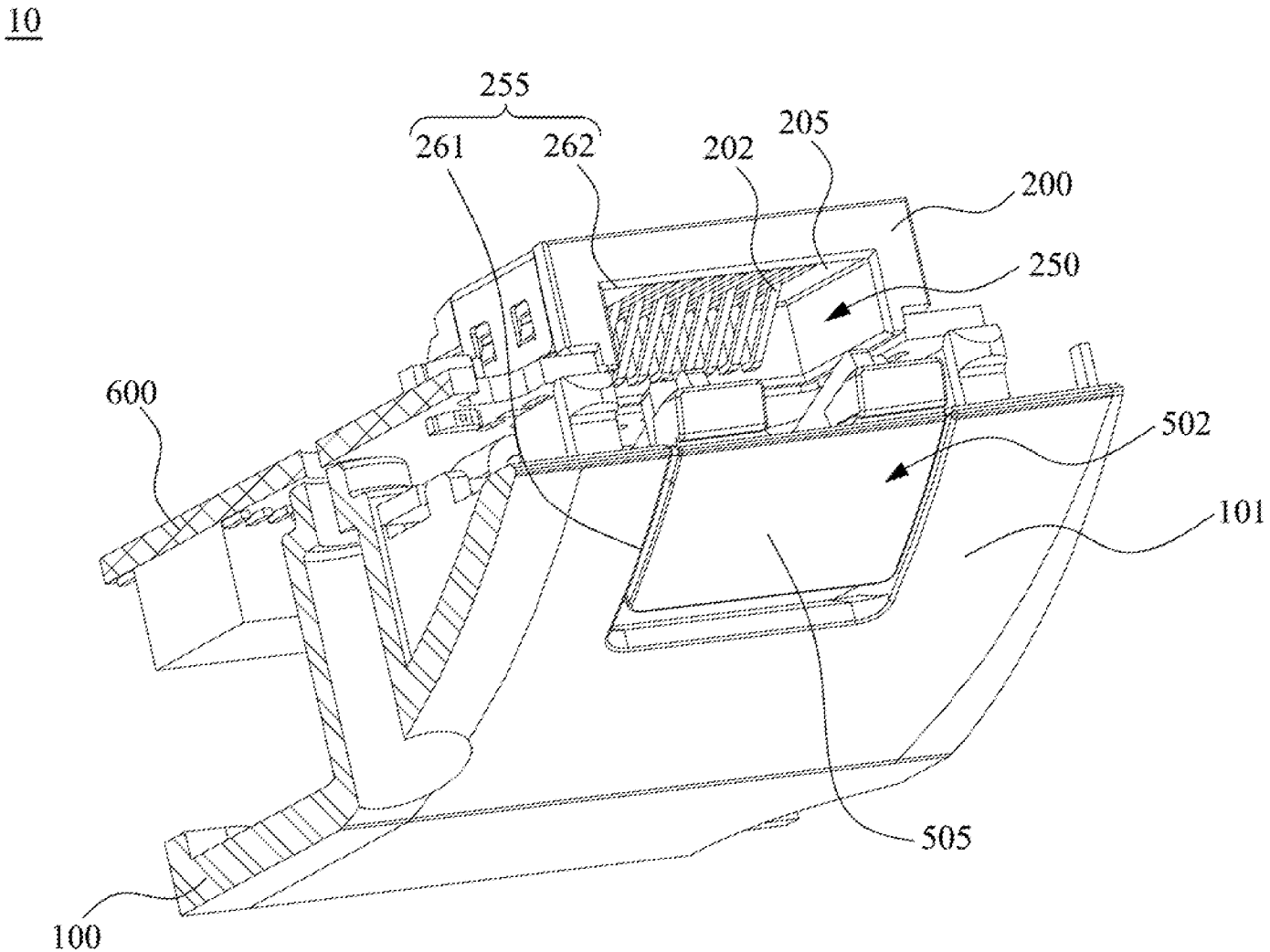
FIG. 1 illustrates an assembly diagram of a receptacle connector according to an embodiment of the invention.
Figure 2:
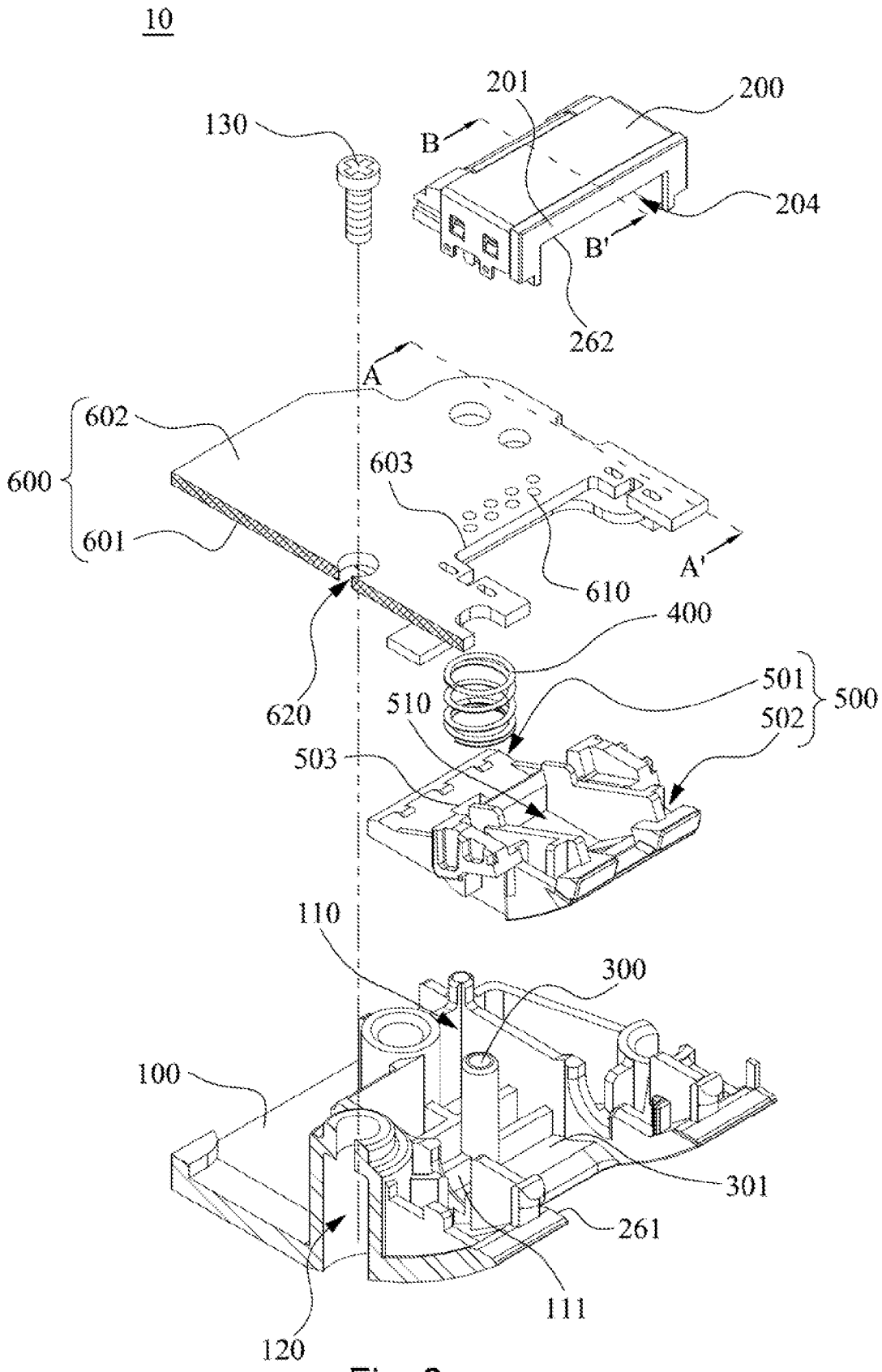
FIG. 2 illustrates an exploded view of FIG. 1.

References are made to FIGS. 1 and 2. FIG. 1 illustrates an assembly diagram of a receptacle connector according to an embodiment of the invention, and FIG. 2 illustrates an exploded view of FIG. 1. It should be noted that, the outer cap and outer shell used for shielding the insulating base 200 are omitted in FIGS. 1 and 2, so as to show main elements of the receptacle connector of this embodiment more clearly.

In this embodiment, the receptacle connector 10 may be a receptacle connector of RJ-45 type, and is applicable but not limited to be connected to a plug connector of RJ-45 type.

The receptacle connector 10 includes a main body 100, an insulating base 200, a tenon member 300, a compressing spring 400, a cap body 500 and a circuit board 600. Here it should be noted that the receptacle connector 10 of this embodiment is adapted to be installed into the shell body of an electronic apparatus (not shown), such as but not limited to the shell body of a notebook computer. The main body 100 can be formed as a part of the shell body of the notebook computer.

The main body 100 includes a first concave area 110 and multiple screw holes 120, for example three screw holes 120 shown in FIG. 2. The screw hole 120 can be used to lock other parts of the receptacle connector 10, such as but not limited to a circuit board 600. In other embodiments of the invention, some of the screw holes 120 may also be connected to the shell body of the electronic apparatus. The tenon member 300 is erected on the bottom surface 301 of the first concave area 110, and may be integrated together with the main body 100, extending from the bottom surface 301 of the first concave area 110.

The insulating base 200 includes a second concave area 204 and plural conductive terminals 202, in which the conductive terminals 202 are disposed on the bottom surface 205 (shown in FIG. 1) of the second concave area 204. The first concave area 110 assembled with the second concave area 204 constitutes a joint cavity 250 and an opening 255. The plug connector 20 (shown in FIG. 4) is adapted to be plugged into the joint cavity 250 through the opening 255, so as to electrically connect with the plural conductive terminals 202 of the second concave area 204.

The opening 255 may be divided into a first concave part 261 and a second concave part 262. The first concave part 261 is disposed on the main body 100, and the second concave part 262 is disposed on the insulating base 200. That is, the position of the first concave part 261 is on the lateral surface 101 of the main body 100, and the first concave part 261 is connected with the first concave area 110; the position of the second concave part 262 is on the lateral surface 201 of the insulating base 200, and the second concave part 262 is connected with the second concave area 204.

The cap body 500 includes a sheath portion 501 and a cover portion 502 which are opposite to each other. The sheath portion 501 has a through hole 503. The tenon member 300 is threaded through the through hole 503, such that the sheath portion 501 of the cap body 500 can move on the tenon member 300 slidably.

The cover portion 502 of the cap body 500 occupies a part of the opening 255. More particularly, the profile of the lateral surface 505 of the cover portion 502 of the cap body 500 and the shape of the first concave part 261 are complementary, such that the lateral surface 505 of the cover portion 502 almost completely occupies the first concave part 261 of the opening 255, and the lateral surface 505 of the cover portion 502 and the lateral surface 101 of the main body 100 together form a cambered surface.

After the cap body 500 of the invention is assembled into the first concave area 110 of the main body 100, the tenon member 300 is threaded through the compressing spring 400, and is connected with the sheath portion 501 of the cap body 500. Subsequently, the tenon member 300 is threaded through a fixing plate 410 (shown in FIGS. 3 and 4), and the fixing plate 410 may be secured on the end of the tenon member 300. As such, when the sheath portion 501 of the cap body 500 slides on the tenon member 300 and compresses the compressing spring 400, the cover portion 502 moves from a closing position to an accessing position relative to the opening 255.

It should be noted that the cap body 500, the compressing spring 400, the fixing plate 410, the circuit board 600 and the insulating base 200 are all assembled onto the main body 100 by facing the first concave area 110 of the main body 100. That is, the cap body 500, the compressing spring 400, the fixing plate 410, the circuit board 600 and the insulating base 200 are all forward assembled onto the main body 100, rather than assembled onto the main body 100 from other directions, so that the receptacle connector 10 of this embodiment has the advantage of easy and fast assembly.

The circuit board 600 includes a first surface 601 and a second surface 602 which are opposite to each other. The main body 100 is fixed on the first surface 601, and the insulating base 200 is fixed on the second surface 602. For example, the circuit board 600 may have plural through locking holes 620, wherein one of the locking holes 620 may be disposed opposite to the position of the screw hole 120 of the main body 100. The receptacle connector 10 may further include a locking accessory 130. The locking accessory 130 passes through the locking hole 620 and is screwed into the screw hole 120, so as to fix the connection between the main body 100 and the circuit board 600.

Furthermore, the circuit board 600 may have a recess part 603, and the position of the recess part 603 is opposite to that of the second concave area 204 of the insulating base 200. A plurality of contact points 610 may be disposed on the second surface 602 of the circuit board 600. The contact points 610 are disposed adjacent to the edge of the recess part 603, so as to electrically connect with the respective conductive terminals 202.

Figure 3:
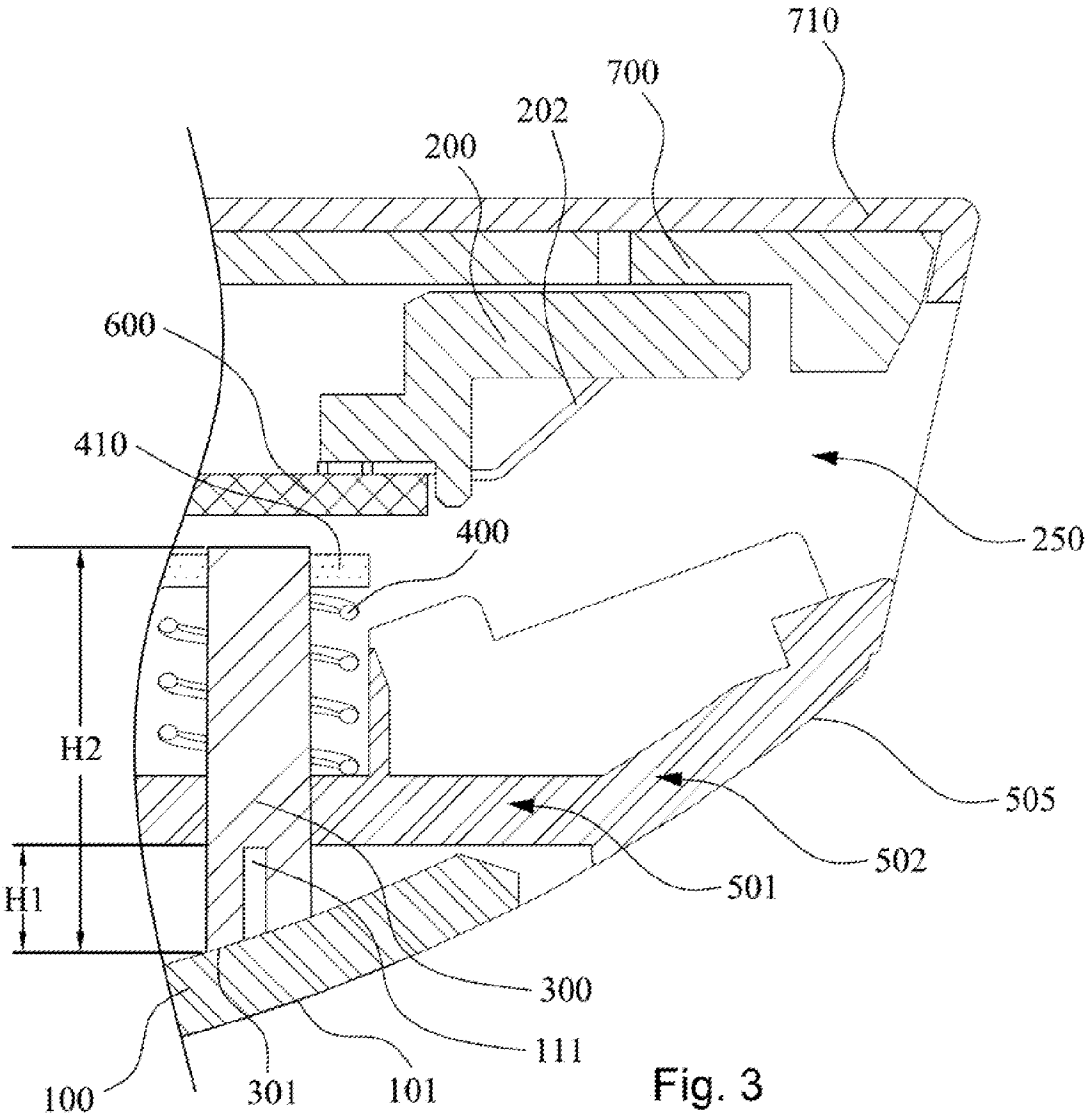
FIG. 3 illustrates a cross sectional view of FIG. 2 taken along a line segment B_B', which shows a closing position of the cap body relative to the opening.

The main body 100 may further include a rib 111 (referring to FIG. 3 at the same time). The rib 111 is disposed on the bottom surface 301 of the first concave area 110, and the height H1 of the rib 111 is smaller than the height H2 of the tenon member 300. When the sheath portion 501 of the cap body 500 is threaded through the tenon member 300, the sheath portion 501 of the cap body 500 is disposed in the first concave area 110 and is supported by the rib 111.

In view of the above, this embodiment discloses a design which connects the main body 100 of the receptacle connector 10 and the cap body 500 through the compressing spring 400, such that when the plug connector 20 is unplugged from the joint cavity 250, through the elasticity of the compressing spring 400, the cover portion 502 of the cap body 500 can be restored to the closing position automatically. The operation manner of the cover portion 502 of the cap body 500 of this embodiment will be described more detailed below.

Reference is made to FIG. 3 first. FIG. 3 shows a closing position of the cap body relative to the opening along the line segment B_B' of FIG. 2, and FIG. 3 depicts the outer cap 700 and outer shell 710 omitted in FIGS. 1 and 2. The outer cap 700 shields the insulating base 200, and may be formed as a part of the shell body of the electronic apparatus for accommodating the receptacle connector 10. The outer shell 710 covers the outer cap 700 and may be a metal outer shell of an electronic apparatus.

As shown in FIG. 3, before the plug connector 20 is plugged into the joint cavity 250, the lateral surface 505 of the cover portion 502 and the lateral surface 101 of the main body 100 form a successive outer surface. The compressing spring 400 is connected between the fixing plate 410 and the sheath portion 501 of the cap body 500, and the compressing spring 400 is in a non-compressed state.

Figure 4:
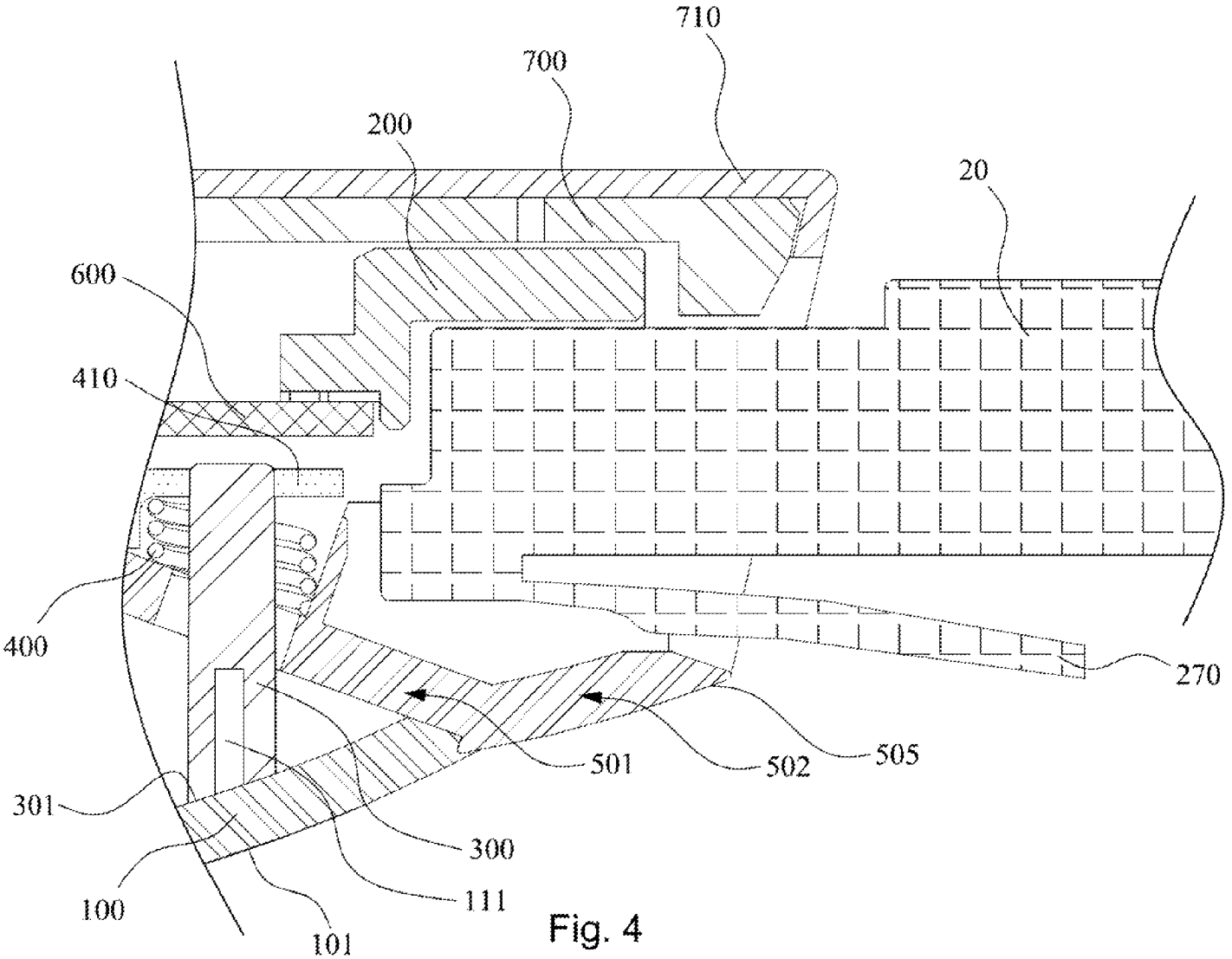
FIG. 4 illustrates a cross sectional view of FIG. 2 taken along a line segment B_B', which shows an accessing position of the cap body relative to the opening.

Thereafter also referring to FIG. 4, it shows the accessing position of the cap body relative to the opening along the line segment B_B' of FIG. 2. As shown in FIG. 4, the cap body 500 is provided with a sliding chute 510 (referring to FIG. 2 at the same time) located in the joint cavity 250. The plug connector 20 matching the receptacle connector 10 of this embodiment may have an engaging piece 270. When the plug connector 20 is plugged into the joint cavity 250 through the opening 255, the engaging piece 270 is engaged into the sliding chute 510.

When the plug connector 20 is plugged into the joint cavity 250, the cap body 500 rotates clockwise, such that the cover portion 502 of the cap body 500 moves clockwise and compresses the compressing spring 400.

It should be noted that the one side of the cap body 500 of this embodiment may include a rotating member for supporting the clockwise rotation of the cap body 500. The rotating member of the cap body 500 will be described in details below.

Figure 5:
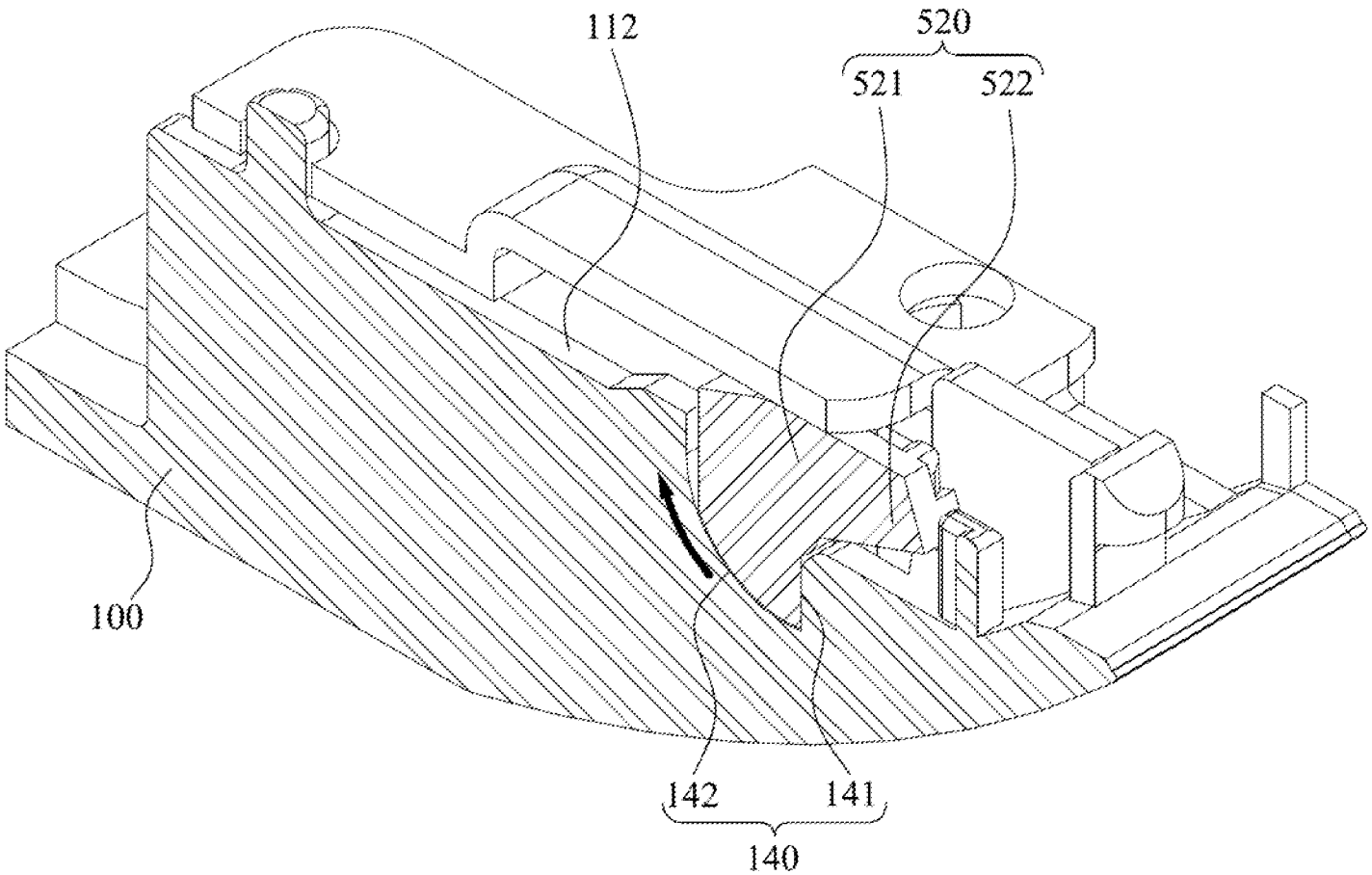
FIG. 5 illustrates a cross sectional view of FIG. 2 taken along a line segment A_A'.

Referring to FIG. 5, it illustrates a cross sectional view of FIG. 2 taken along a line segment A_A'. As shown in FIG. 5, the cap body 500 has a rotating member 520, and the sidewall 112 of the first concave area 110 of the main body 100 is provided with a notch 140. The position of the notch 140 is opposite to that of the rotating member 520, such that the rotating member 520 is partially disposed inside the notch 140.

The rotating member 520 includes a first portion 521 and a second portion 522. The first portion 521 is disposed inside the notch 140, and the second portion 522 extends from the first portion 521 and is protruded from the notch 140, facing the sidewall 112 of the first concave area 110.

The notch 140 includes a stop surface 141 and a slide surface 142. FIG. 5 illustrates the condition that the cover portion 502 of the cap body 500 is disposed at the closing position relative to the opening 255, in which the first portion 521 of the rotating member 520 of the cap body 500 abuts against the stop surface 141. When the cover portion 502 moves from the closing position to the accessing position relative to the opening 255, the first portion 521 slides along the slide surface 142 until the second portion 522 abuts against the sidewall 112 of the first concave area 110. As such, through the rotating member 520, the second portion 522 of the cap body 500 can be limited to move between the accessing position and the closing position relative to the opening 255.

In view of the above, for the aforementioned receptacle connector disclosed in the embodiments, the tenon member erected on the bottom surface of the main body is threaded through the compressing spring forwardly, which eases the assembly of the receptacle connector. Moreover, the compressing spring is connected to the main body and the cap body, and via the rotating member located at a side of the cap body, when the plug connector is plugged into the receptacle connector, the cap body can rotate clockwise along the rotating member as the axis center. When the plug connector is unplugged from the receptacle connector, via the elastic restoring force of the compressing spring, the cap body rotates counterclockwise around the rotating member as the axis center, such that the cap body can be restored to the closing position automatically.

Although the invention has been disclosed with reference to the above embodiments, these embodiments are not intended to limit the invention. It will be apparent to those of skills in the art that various modifications and variations can be made without departing from the spirit and scope of the invention. Therefore, the scope of the invention shall be defined by the appended claims.

What is claimed is:

1. A receptacle connector, adapted for being connected to a plug connector, the receptacle connector comprising:

a main body comprising a first concave area; an insulating base having a plurality of conductive terminals and comprising a second concave area, the first and second concave areas constituting a joint cavity and an opening, such that the plug connector is adapted to be plugged into the joint cavity through the opening;

a tenon member erected on the bottom surface of the first concave area;

a compressing spring, wherein the tenon member is threaded through the compressing spring; and a cap body comprising a sheath portion and a cover portion which are opposite to each other, wherein the sheath portion is slidably threaded through the tenon member and is connected to the compression spring, the cover portion occupies a part of the opening, and the plug connector is adapted to push the cap body such that the sheath portion compresses the compressing spring and the: cover portion is enabled to move from a closing position to an accessing position relative to the opening;

wherein the sidewall of the first concave area has a notch; the cap body has a rotating member; the rotating member comprises a first portion and a second portion; the first portion is disposed inside the notch; the second portion extends from the first portion and is protruded from the notch, facing the sidewall of the first concave area; when the cover potion is located at the accessing position, the second portion abuts against the sidewall of the first concave area.

2. The receptacle connector of claim 1, wherein the notch comprises a stop surface and a slide surface; when the cover portion is located at the closing position, the first portion abuts against the stop surface; and when the cover portion moves from the closing position to the accessing position, the first portion slides along the slide surface until the second portion abuts against the sidewall of the first concave area.

3. The receptacle connector of claim 1, wherein the cap body has a sliding chute located in the joint cavity; the plug connector has an engaging piece, and when the plug connector is plugged into the joint cavity, the engaging piece is engaged with the sliding chute.

4. The receptacle connector of claim 1, wherein the opening is divided into a first concave part and a second concave part, wherein the first concave part is located on the main body; the second concave part is located on the insulating base; and the profile of the cover portion of the cap body and the first concave part are complementary.

5. The receptacle connector of claim 1, wherein the main body further comprises a rib located on the bottom surface of the first concave area; the height of the rib is smaller than that of the tenon member; and the sheath portion of the cap body is located in the first concave area and is supported by the rib.

6. The receptacle connector of claim 1, wherein the receptacle connector is installed into a shell body of an electronic apparatus.

7. The receptacle connector of claim 1, further comprising a circuit board, wherein the circuit board comprises a first surface and a second surface which are opposite to each other; the main body is fixed on the first surface; the insulating base is fixed on the second surface; and the circuit board has a plurality of contact points which are electrically connected with the respective conductive terminals.

8. The receptacle connector of claim 7, wherein the circuit board has a recessed part, and the position of the recessed part is opposite to that of the second concave area.

9. The receptacle connector of claim 7, further comprising a locking accessory, wherein the main body further comprises a screw hole; the circuit board further comprises a locking hole; the position of the screw hole faces to that of the locking hole; and the locking accessory passes through the locking hole and is screwed into the screw hole, so as to fix the connection between the main body and the circuit board.

* * * * *